US005669543A

United States Patent [19]

Ueno

[11] Patent Number: 5,669,543

[45] Date of Patent: Sep. 23, 1997

[54] HOLLOW NEEDLE FOR TAG ATTACHER

[75] Inventor: Hideyuki Ueno, Yokohama, Japan

[73] Assignees: Kotec's Co., Ltd.; Toska Co., Ltd., both of Tokyo, Japan

[21] Appl. No.: 554,803

[22] Filed: Nov. 7, 1995

[30] Foreign Application Priority Data

Dec. 16, 1994 [JP] Japan ..... 6-313796

[51] Int. Cl.[6] ..... B25C 1/00

[52] U.S. Cl. ..... 227/67; 604/273; 604/274; 112/222

[58] Field of Search ..... 227/67, 71; 112/222; 163/1, 5; 604/272, 273, 274; 606/117, 148

[56] References Cited

U.S. PATENT DOCUMENTS

| | | | |
|---|---|---|---|
| 3,470,834 | 10/1969 | Bone | 227/67 |
| 3,815,798 | 6/1974 | Lavitch et al. | 227/67 |
| 3,872,806 | 3/1975 | Bone | 227/67 |
| 3,895,753 | 7/1975 | Bone | 227/67 |
| 3,924,617 | 12/1975 | Ferro | 604/274 |
| 4,585,446 | 4/1986 | Kempf | 604/274 |
| 4,795,446 | 1/1989 | Fecht | 604/273 |
| 4,826,492 | 5/1989 | Magasi | 604/274 |

*Primary Examiner*—Scott A. Smith

*Attorney, Agent, or Firm*—Nikaido, Marmelstein, Murray & Oram LLP

[57] ABSTRACT

A hollow needle for tag attachers, which comprises a blade (2) made by press working of a thin metal plate and a shank (3) of a synthetic resin integrally secured at a rear end part of the blade (2), wherein the blade (2) includes a front end part (2a) which has in a middle part thereof a semicircular shape in section and is formed in an outer surface portion thereof with a resistance reducing part (4) provided by partly depressing the outer periphery thereof, whereby the area of contact of a front end part of the hollow needle with an object partly through which the needle is applied in use is reduced and the needle has a desirable characteristic such that it can be applied straight in use.

12 Claims, 7 Drawing Sheets

FIG. 14
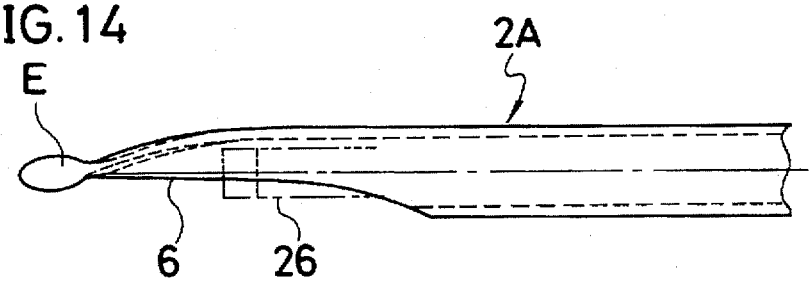
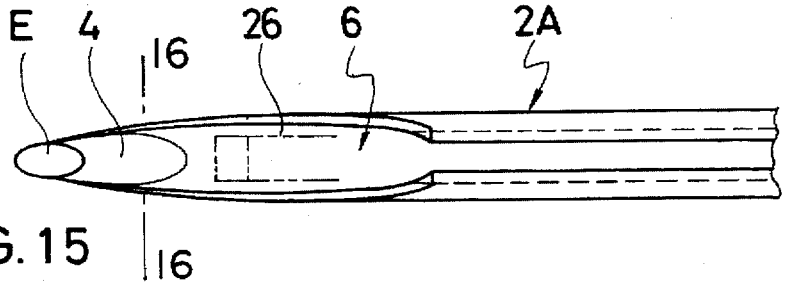
FIG. 15
FIG. 16
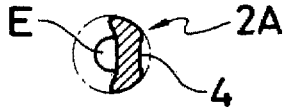
FIG. 17
PRIOR ART
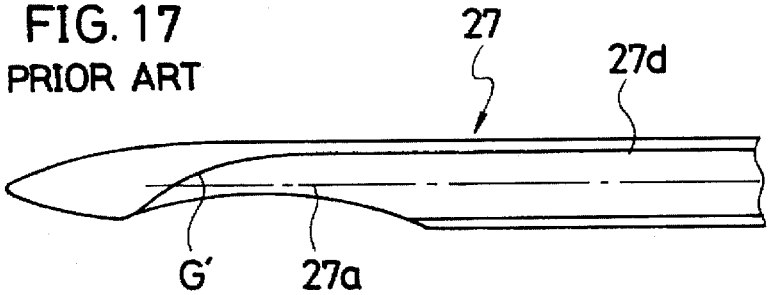
FIG. 18
PRIOR ART
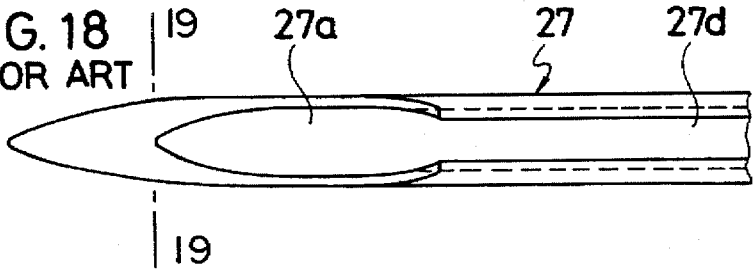
FIG. 19
PRIOR ART
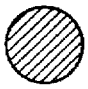

HOLLOW NEEDLE FOR TAG ATTACHER

BACKGROUND OF THE INVENTION

The present invention relates to a hollow needle which is removably secured to a nose end of a tag attacher and through which tag pins are guided as they are one by one shot with the tag attacher. More specifically, the invention relates to an improvement in or relating to such hollow needle.

The tag pin, also referred to simply as pin, is a device used typically for tagging, namely anchoring tags of the like to merchandise such as fabric made goods for example.

In greater detail, as shown in FIG. 23 and FIG, 24 of the accompanying drawings, the tag pin shown at t comprises a head h of a thin plate form, a filament f extending from a central point of a lower edge of the head h, virtually at a right angle to the head, and a crossbar b formed at a right angle to the filament f at a lower end of the latter. The head, filament and crossbar are altogether integrally formed from a synthetic resin such as nylon or polypropylene in an overall shape broadly resembling a letter H. A large number of such tag pins t is connected through their respective connection parts c formed at a central point of their respective crossbars b to a single rod or bar B to altogether form a tag pin assembly T having tag pins arranged like teeth in combs.

The tag attacher referred to also as tagging gun or simply gun is a hand-operable machine and, as shown at 20 in FIG. 25, comprises a machine body 21 formed in a front part thereof with a vertically extending guide groove 22 in which tag pin assemblies T are loaded one at a time. In use, an operation lever or a trigger 24 applied with a spring force and pivotably mounted in a front part of a handle 23 is triggered, whereby a pressing member 25 movable back and forth inside the gun 20 is driven and the crossbar b of a tag pin t of a tag pin assembly T loaded in the groove 22 is pressed at its one end by a piston 26 secured to and extending forwardly from a front end of the pressing member 25, bringing a part at the other end of the crossbar b to enter a rear end portion of a guide hole of a hollow needle 27 later to be described in greater detail, and at the same time as this, cutting is made at the connection part c of the tag pin t to sever this tag pin t from the tag pin assembly T.

To attach or anchor for example a tag to an item of merchandise such as clothing, the tag is placed on the item, then the hollow needle 27 forwardly projecting from a nose end of the tag attacher 20 is applied through a hole preparatively formed in an upper end part of the tag and then through the web of the item and, in the condition in which a tip end part of the needle 27 is positioned on the rear or other side of the web of the item, the operation lever 24 pivotably projecting in a front end part of the handle 23 is triggered to shoot the crossbar b of the severed tag pin t through the merchandise item.

Generally, operations for applying tag pins t to merchandise is done highly rapidly each time through a single gripping at the operation lever 24. For example, in preparation for displaying merchandise ready for sales, it is generally required to rapidly carry out an operation for applying for example price tags to virtually identical points of a large number of articles to be displayed, for example in a condition of being hung on hanger racks or the like. Similarly, in the cases of a markup or markdown, replacement of price tags has to be carried out within a short period of time.

To cope with the need for completing the operation for applying price tags or the like within a relatively limited length of time as above, it has been increasingly frequently of practice to make use of tag pins and tag attachers for dispensing the pins with which the tag applying operations can be made each time only through a single triggering action made of the tag attacher.

Merchandise includes a variety of products such as blouses which are made of relatively thin woven fabrics, underwears which are made of soft and pliable woven or knit fabrics, leather-made goods, jeans which are made of relatively thick and stiff woven fabrics, and so forth, and such different products exhibit different resistance characteristics when they undergo piercing application of a hollow needle.

In the cases of products made of soft and pliable woven fabrics, a hollow needle of a diameter on the order of 1.3 to 2.0 mm is gently applied to pierce the fabrics, and the resistance against piercing of the needle is in this case not very considerable. However, in the cases of such as a relatively stiff woven fabric and fabrics having a relatively high density texture such as jeans or denims, and a leather-made goods, the resistance tends to be fairly considerable. Further, in the cases of such as handkerchieves, neckerchieves, and stockings and socks, although they do not have a high resistance to the piercing of a hollow needle individually, the resistance is as a matter of course increased in piercing the needle through a piled or stacked set comprising a plurality of them.

To apply or attach tags or the like to merchandise, it is necessary to operate both the step of piercing a hollow needle 27 through a product and the step of gripping-in or triggering of the operation lever 24 at once and yet within a short spell of time. While such tag attaching operation is performed in many instances by female sales persons, as they continue the operation for a long period of time they are likely to suffer from a considerable degree of fatigue and occasionally a muscular trouble such as tenosynovitis.

Also, lately there have been increasingly developed products of a very fine or delicate texture, and in order not to impair such products with a hole of a relatively large size opened therethrough, studies and attempts have been made to minimize the diameter of crossbars b of tag pins t and also the outer diameter of hollow needles 27.

However, the crossbar b is a part of the tag pin t which functions as stopper or anchor for securing a price tag or the like onto merchandise, and a limitation is applicable to the degree to which the diameter of the crossbar b can be reduced such that the diameter should necessarily be on the order of 0.8 mm at smallest. Thus, the outer diameter of the hollow needle 27 for guiding the crossbar b through it has to to be on the order of 1.3 to 2.0 mm at smallest.

As a matter of course, it is desirable that the resistance the hollow needle 27 has to undergo as it is applied through merchandise is as small as possible. As means for reducing or suppressing the resistance, methods are known such as a one according to which the outer surface of the needle is processed with polishing, a one according to which the needle is processed with plating so as to make it having a low friction surface, and a one according to which the tip end shape of the needle is sharpened, but none of such known methods is expected to attain a remarkable effect of reducing or suppressing the resistance.

In a further aspect, hollow needles are classified into two types or kinds depending on the process by which they are produced. In a first process, the hollow needles are produced by machining a steel rod, and according to this process, it is possible to provide a web thickness as desired in prescribed portions of the needle and accordingly produce needles of a relatively high quality, but problems are involved that since needles have to be produced one by one by machining, a mass production of needles cannot be made, and that since the steel rod is relatively expensive, the product needles, too, are relatively expensive. In a second process, needles are produced by pressing a thin metal plate, and according to this process, the needles can be produced at a considerably lower cost than according to the first process.

As shown in FIG. 17 to FIG. 19, by machining the hollow needle 27 is provided by machining a round steel rod to define an outer and an inner diameters, forming a central bore 27*d* in the longitudinal direction and providing an opening 27*a* in a tip end portion. An error is likely between the center of the machined inner diametral surface and that of the outer diametral surface, and as a result of this, the needle often tends to involve unevenness in the web thickness and unavoidably eccentricity. Also, in view of this, it is indispensable to set the web thickness to be relatively large, resulting in a needle having a relatively large outer diameter.

Then, according to the production by press working, a thin metal plate is used as material, so that the needles produced by this process are characterized in that their web thickness is almost even all over and yet relatively small. Thus, it is possible to attain a reduction of the outer diametral size of needles and of the application resistance of the needles.

With a hollow needle 27 produced by a conventional press working as illustrated in FIG. 20 to FIG. 22, the outer surface portion shown at 27*b* on the side opposite to the opening 27*a* formed on a side in a front end part of the needle is formed in an arc shape and the inner surface of the portion 27*b* is formed to comprise an arc (or curved) surface G having a radius smaller by the difference corresponding to the thickness of the metal plate than the radius of the outer surface portion 27*b*. The inner surface comprising the are surface G is a guide surface for permitting the crossbar b of tag pin t to come out laterally outwardly of the tip end of the hollow needle 27 through the opening 27*a* thereof, and it comes under a needle part exhibing an important function.

By the press working, hollow needles are produced broadly by the steps of punching a thin metal plate and shaping the punched piece to a pipe form by pressing, so that the needles have a thin and constant web thickness. As clearly perceivable with reference to FIG. 17 and FIG. 20, which may be had for purposes of comparative review of hollow needles particularly with respect to the contours of their tip end parts, in order to provide a guide surface for permitting the crossbar b to be slidably quickly shot out of the opening 27*a* it is necessary to so form the outer surface portion 27*b* as to comprise an arc surface having an extreme roundness.

In greater detail, while with the hollow needle produced by press working shown in FIG. 20, it is that the radius of the outer surface portion 27*b* and that of the arc surface G of the inner surface in the part of the opening 27*a* are virtually identical with each other, it is with the needle produced by machining shown in FIG. 17 that in comparison with the radius of the arc surface in the part of the opening 27*a*, shown at G', the radius of the outer surface portion is larger by the difference corresponding to the web thickness. In other words, it is possible to form an inner arc surface G' regardless of the contour of the tip end part of the needle. Also, hollow needles today on the market include many of such ones as having their tip ends at a length position beyond the end of their center line 27*c* as shown in FIG. 20.

Now, a brief study will be made of the area of contact of needles with merchandise, for example clothing. The hollow needle 27 produced by machining has a round shape in section as shown in FIG. 19 taken on line H—H at a front end portion of the needle 27 as shown in FIG. 18. In contrast to this, the hollow needle 27 produced by press working has a semicircular or an arc shape in section as shown in FIG. 22 taken on line H—H in FIG. 21. Thus, while the area with which the machined needle 27 contacts for example an item of clothing when it is applied through the latter is a round one, such contact area is semicircular and is reduced to one half in the case of the needle produced by press working.

Further, in the case of the production by press working, it is indispensable to so form a whole of the outer surface portion 27*b* as to have an extreme roundness as shown in FIG. 20, and accordingly it is impossible according to the press working to form the tip end part of the needle 27 so fine and smoothly contoured as according to the machining.

As shown in FIG. 20, the hollow needle 27 produced by press working may be applied through a fiber-made article such as a clothing item in the direction of an arrow D, when it tends to occur that the outer surface portion 27*b* is pressed in an inclined position against fibers, whereby there is likely to be produced a force acting to deviate the needle laterally in the direction of an arrow E and, as it is driven to advance, the needle tends to undergo a lateral movement leaving the center line 27*c*. When this occurs, an error is produced in the direction of application of the needle, tending to broaden the hole being opened in the article by needle being applied and impair the article with the opening therein of a hole of a relatively large size. Further, in order to maintain the hollow needle to be applied in a proper straight direction, the resistance in the needle application is increased, requiring the person engaged in the tag attaching operation to exert an increased amount of labor.

As earlier pointed out, according to the machining, the production of hollow needles is relatively costly, and formation of the central hole or bore in the needle is prone to be eccentric relative to the outer surface portion. Moreover, the needles produced by machining have a round sectional shape as shown in FIG. 19, so that although they are desirable in that they can be applied straight with ease, they cannot avoid undergoing a relatively large extent of resistance in application in that they receive the resistance over a whole periphery in their respective front end part.

With the hollow needles produced by press working, on the other hand, although their area of contact with for example fibers is more or less smaller than (or reduced to about one half of) that of the above needles produced by machining as shown in FIG. 22, they have a sectional shape of a C-letter form in their front end part as shown in FIG. 20 and FIG. 22, so that they tend to undergo uneven actions of external force. It has been ascertained also that they tend to permit an error to take place in the direction in which they are applied through articles.

SUMMARY OF THE INVENTION

The present invention has been made in view of the above indicated shortcomings and problems with the existing hollow needles, and the primary object of the invention is to provide a hollow needle improved in that although it belongs to hollow needles produced by press working, it can be applied straight with more ease and yet with less resistance than the existing hollow needles, so that it can easily such as the tag attaching operation and the setting operation for putting a plurality of articles altogether to the form of sets or bundles. Also, the needle according to the invention can serve to provide a tag attacher with which the above operations can be carried out over a long spell of time without causing much of fatigue, whereby the cost of handling and administration of merchandise in shops and stores can be curtailed.

The hollow needle for attaining the above object according to the present invention, shown at 1 for example in FIG. 1, broadly has the following structural features:

(A) The hollow needle 1 comprises a blade 2 made of a thin metal plate by press working and a shank 3 made of a synthetic resin and integrally secured to a rear end part of the blade, and in a middle portion of a front end part 2*a* of the blade 2, this needle has a semicircular shape in section. On the outer surface of the front end part 2*a*, a resistance reducing part 4 is formed by partly reducing the peripheral circle.

(B) The blade 2 comprises a front end part 2*a*, an intermediate part 2*b*, a fixing part or an attachment part 2*c* and a cutter part 2*d*.

(C) The intermediate part 2*b* of blade 2 is generally in the form of a cylinder and is formed with a slit 7 along a side thereof, and its rear end portion is flattened to form the cutter part 2*d*, a rear end portion of which is partly sharpened to form a cutting blade 12 having protective parts 11 formed at its sides.

(D) The resistance reducing part 4 in the front end part 2*a* of the blade 2 is formed in a length portion between the point of the needle 1 and a point at about one half of the distance between the point of the needle and a front end of a piston 26 of a tag attacher moved to its forward end.

(E) The resistance reducing part 4 is a part formed so as to reduce the degree, or the area, of contact of the front end part 2*a* of the blade 2 with an article when the needle 1 is applied through the article, and for the formation of this part, the front end part 2*a* is formed by providing a convex surface portion 4*a* having a radius $R_3$ with its center positioned on the side of an opening 6 and by making a central part of the convex surface portion 4*a* comprising a flat or slightly recessed surface.

(F) The front end part 2*a* in the blade 2 is formed by the convex surface portion 4*a* of radius $R_3$ having its center on the side of the opening 6, this surface portion 4*a* including a central part which is recessed or curved oppositely of the convex surface portion 4*a* and which has a radius $R_1$.

As pointed out above, an important characteristic of the hollow needle 1 according to the invention resides in that the needle is provided in its front end part 2*a* with the resistance reducing part 4 bringing about the effect of reducing the degree, or the area size, of contact of the needle with an article through which the needle is applied. In applying the hollow needle 1 through an item of merchandise for example at the times of attaching price tags or the like to the merchandise, the area of contact of the outer surface in a front end part of the needle with for example a fabric or texture comprising fibers can be reduced according to the invention. In addition, the needle can be applied to partly pierce an article without producing a force tending to act in a direction to deviate from the central axis of the needle so that the needle can exhibit a remarkable characteristic of being applied straight or a remarkable piercing characteristic, whereby a reduction can be made of the resistance in applying the needle. As a result of the above, various economical advantages can be brought about such that the operation for attaching price tags or the like can be performed at a high operation efficiency, that the danger of impairing merchandise can be advantageously suppressed, and that durability strength of the needle can be improved.

BRIEF DESCRIPTION OF THE DRAWINGS

FIG. 14 is a side elevation, showing a hollow needle according to another embodiment of the invention;

FIG. 15 is a fragmentary front elevation, showing a portion of the hollow needle of FIG. 14;

FIG. 16 is a sectional view, taken on line H—H in FIG. 15;

FIG. 17 is a fragmentary sectional view, showing a front end part of a conventional hollow needle produced by machining;

FIG. 18 is a front elevation of FIG. 17;

FIG. 19 is a sectional view, taken on line H—H in FIG. 18;

DESCRIPTION OF THE PREFERRED EMBODIMENTS

Figure 1:
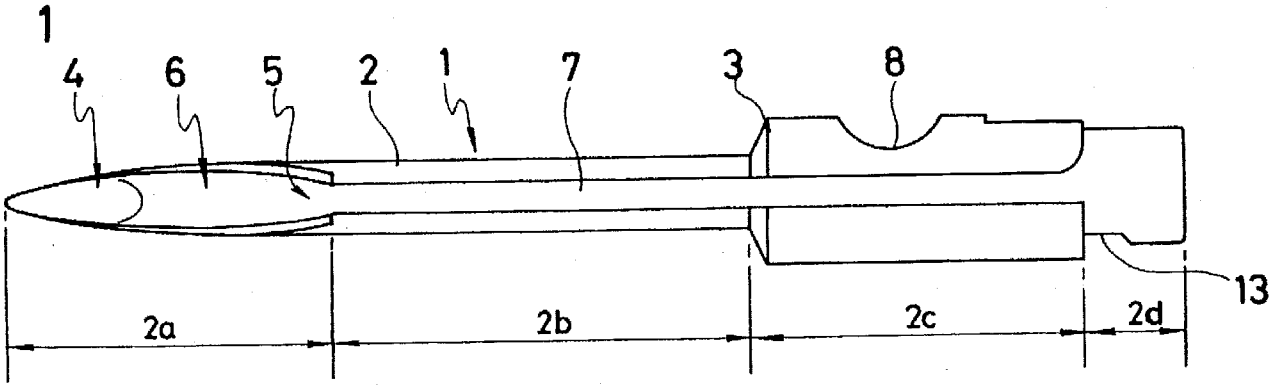
FIG. 1 shows a front elevation of a hollow needle pertaining to an embodiment of the present invention.
Figure 6:
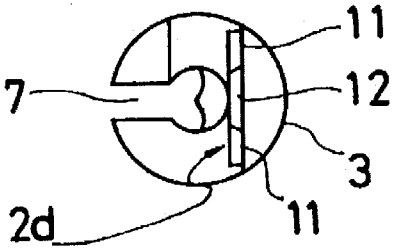
FIG. 6 is also a side elevation of the needle but viewed from the side of the cutter part thereof.
Figure 10:
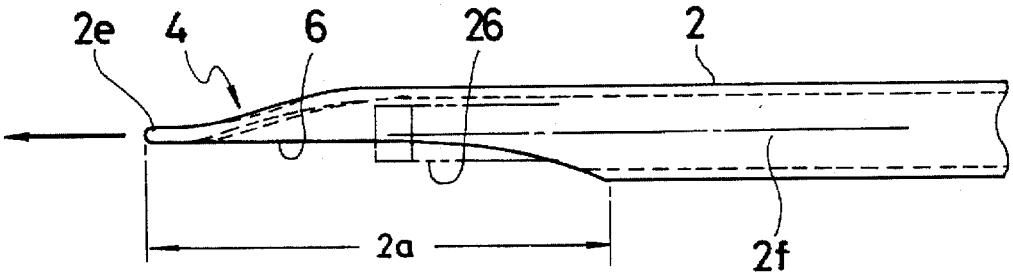
FIG. 10 is a side elevation, showing essential portions of the hollow needle embodying the invention.
Figure 11:
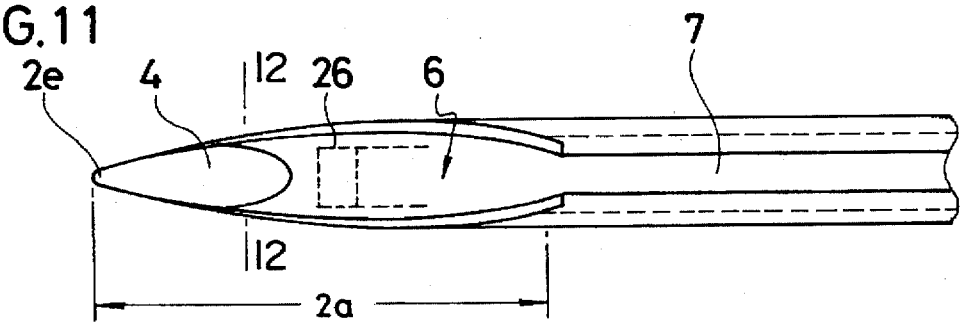
FIG. 11 is a front elevation, showing essential portions of the needle of FIG. 10.

Now, the present invention will be described in further detail with reference to specific embodiments thereof illustrated in several figures of drawings, which are hereto attached and of which FIG. 1 shows a front elevation of a hollow needle for a tag attacher according to an embodiment of the present invention, FIG. 2 being a top plan view of FIG. 1, FIG. 3 being a bottom plan view of FIG. 1, FIG. 4 being a rear elevation of FIG. 1, FIG. 5 being a side elevation viewed at the hollow needle from the side of the point thereof, and FIG. 6 being another side elevation of the needle viewed from the side of the cutter part thereof; further, FIG. 10 is a side elevation, showing in enlargement a front end part of the needle, FIG. 11 showing a front elevation of FIG. 10, and FIG. 12 being a sectional view, taken on line F—F in FIG. 11.

The hollow needle embodying the invention is indicated at 1, which comprises a blade 2 and a shank 3 provided at a rear end of the blade 2. In the present embodiment of the invention, the blade 2 is formed broadly by the steps illustrated in FIG. 7 to FIG. 9, of punching a thin plate of for example a high-carbon tool steel having a thickness of 0.2 to 0.25 mm to a piece having the prescribed shape, processing an intermediate part **2*b* to a cylindrical form, forming one end portion of the intermediate part 2*b* to provide a front end part 2*a* having a semicircular sectional shape and a particular form, forming a portion at the other end of the intermediate part 2*b* to provide a fixing part 2*c* of a flat plate form, and forming a cutter part 2*d* connected to and rearwardly extending from the end of the fixing part 2*c***, all the parts being integrally formed.

Figure 7:
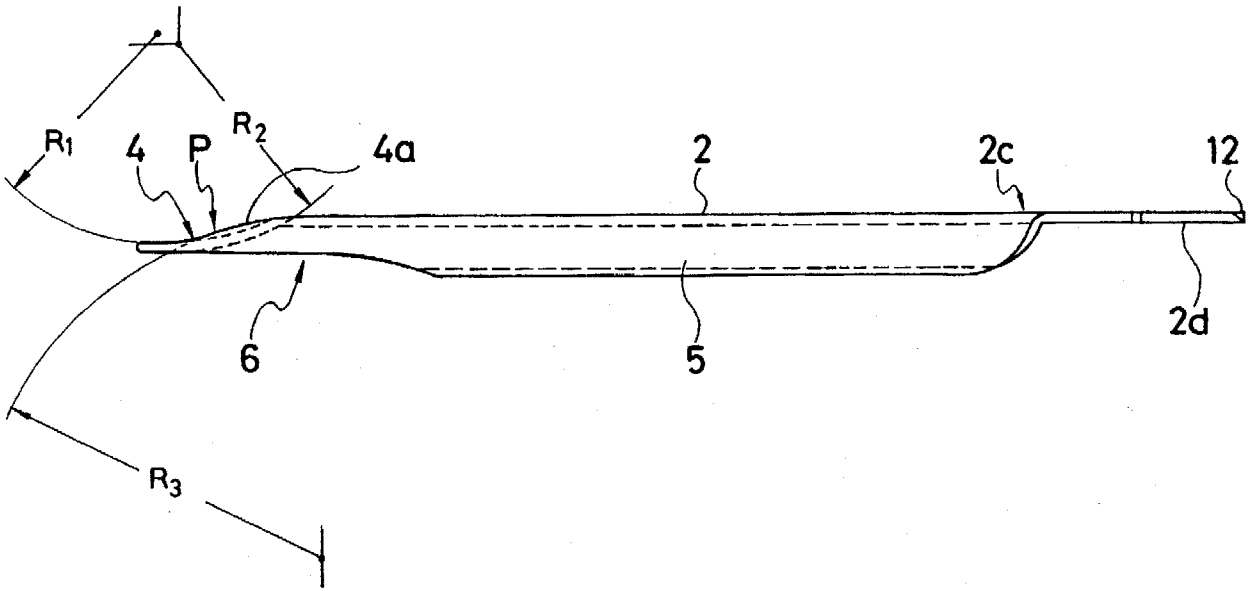
FIG. 7 is a side view, showing the blade of the needle, produced by press working.

As shown in FIG. 7, the front end part **2*a* is formed with a resistance reducing part 4 comprising a curved surface part having on a back-side surface a radius $R_1$ and, on an inner surface, a radius $R_2$ defined with the thickness of the material plate or the web thickness taken into consideration. From an intermediate point in its length, the curved surface part is deformed to a convex surface part 4*a*** having a radius $R_3$, so that this curved surface part forms a complex curved surface comprising a concave surface in a portion and a convex surface in the rest.

Figure 8:
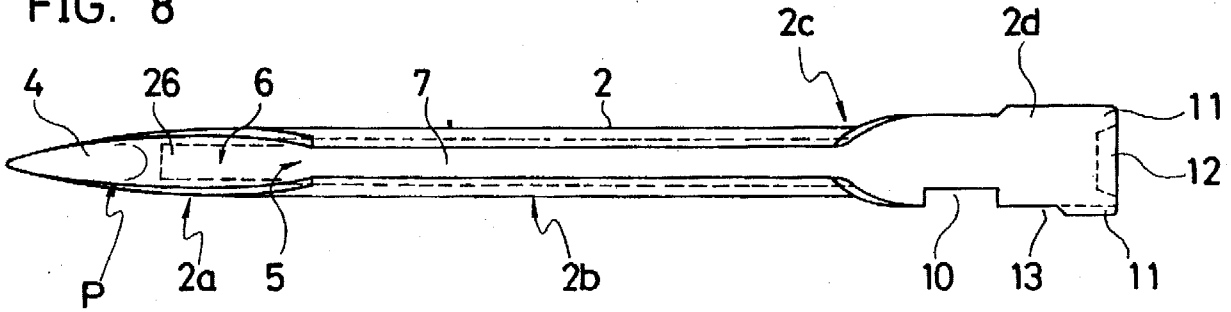
FIG. 8 is a front view of the blade of FIG. 7.
Figure 25:
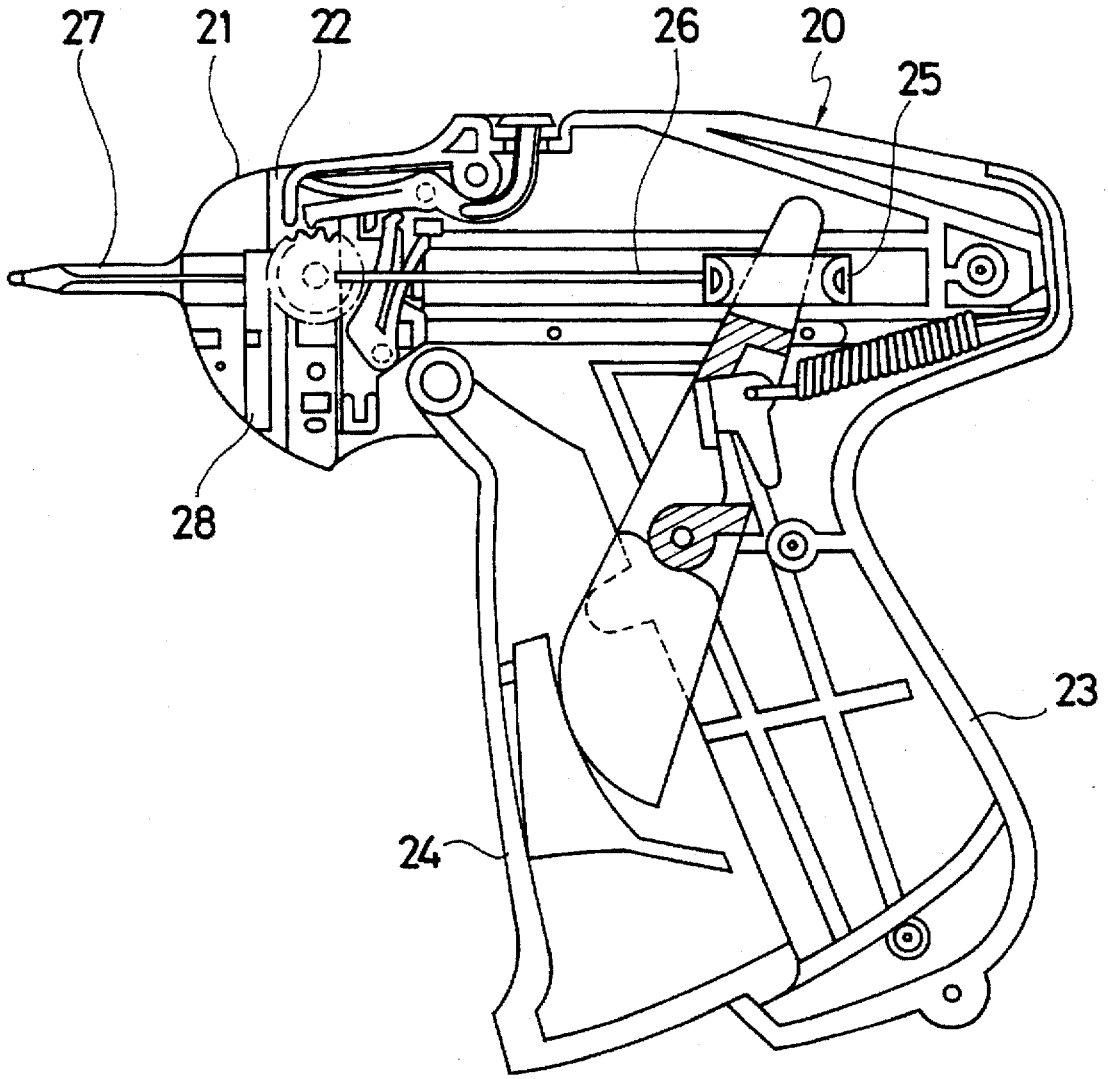
FIG. 25 is a side elevation, showing structural details inside an example of tag attachers.

As shown in FIG. 8, further, the curved surface part, namely the resistance reducing part 4 is formed up to a point along the front end part **2*a* closely adjacent to but not reaching the point which is reached by the leading end of a piston 26 in the tag attacher shown at 20 in FIG. 25 when the piston 26 is advanced, the piston being moved back and forth by operating a trigger or an operation lever 24 of the tag attacher in a manner such that when the piston 26 is advanced, its leading end reaches an intermediate point along an opening 6 formed in the front end part 2*a* of the needle 1**.

Figure 5:
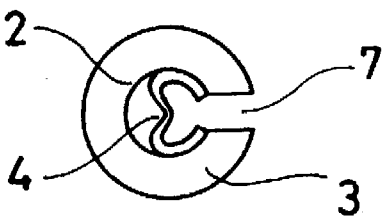
FIG. 5 is a side elevation viewed at the needle from the side of the point thereof.

As shown in the cross-sectional view of FIG. 5, the resistance reducing part 4 forms a recess or groove, so that in use of the hollow needle, the two convex parts or ridges at the sides of the recess or groove contact for example fibers of an article through which the needle is applied but the groove does not undergo a contact with the fibers. Thus, the front end part **2*a* of the needle is in a form of being formed with guide rails. Therefore, with the hollow needle according to the invention, not only the area of contact of this front end part 2*a*** is reduced, but also the needle is provided with guide means when it is applied partly through merchandise.

Further, the resistance reducing part 4 serves to reduce the contact area of the needle when the needle is applied to partly pierce merchandise and accordingly the resistance or pressure as above, and it has a concave or flat bottom shape in section as shown in FIG. 5 and also in FIGS. 12 and 16 later to be described in greater detail.

In brief, the resistance reducing part 4 means such a needle part which reduces the contact area of the needle with for example fibers of merchandise and thereby reduce the resistance to be produced when the needle is applied partly through the merchandise, whereby the danger of impairing the merchandise by the needle is suppressed and facilitate or easify for example the tag attaching operation. The hollow needle 1 according to the present invention essential differs from the conventional or existing hollow needle shown in FIG. 20 to FIG. 22 in that it has the above described resistance reducing part 4 having a concave sectional shape, which is not had with the conventional hollow needle, which is in the form of a smoothly shaped bullethead having a relatively sharp point.

Figure 23:
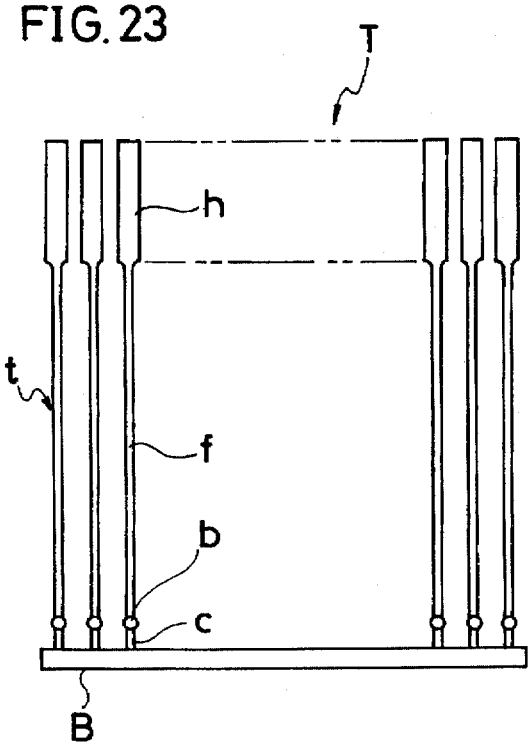
FIG. 23 is a side elevation of a tag pin assembly.
Figure 24:
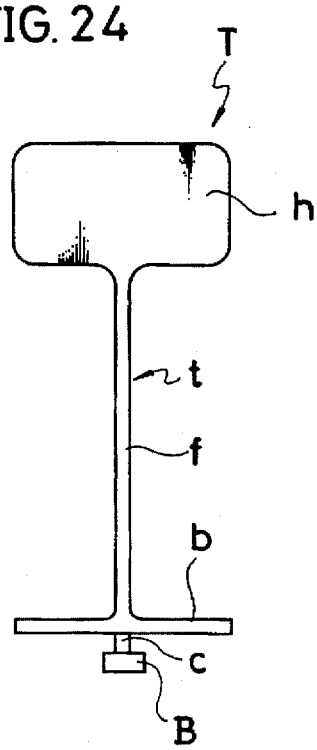
FIG. 24 is a front elevation of the tag pin assembly of FIG. 23.

As shown in FIG. 1, the front end part **2*a* of the hollow needle 1 is formed with an opening 6 of a teardrop shape for letting the crossbar b of the tag pin t (FIGS. 23 and 24) come out of the central bore 5 of the needle 1, and from a rear end of the opening 6, a slit 7** of a constant width is continuously formed, through and along which the filament f of the tag pin t is guided when the tag pin t is shot with the tag attacher.

Figure 9:
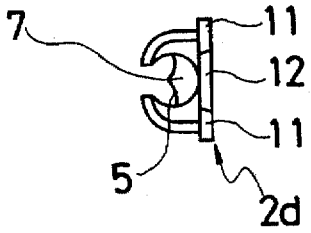
FIG. 9 is a right-side view of the blade of FIG. 8.

In the production of the hollow needle 1, as shown in FIG. 7 to FIG. 9 the blade 2 made by pressing a thin metal plate of a high-carbon tool steel for example is placed in a mold of a molding machine, and with a synthetic resin charged into the mold, the shank 3 is formed at the position of and integrally with the fixing part **2*c* (FIG. 8**).

Figure 2:
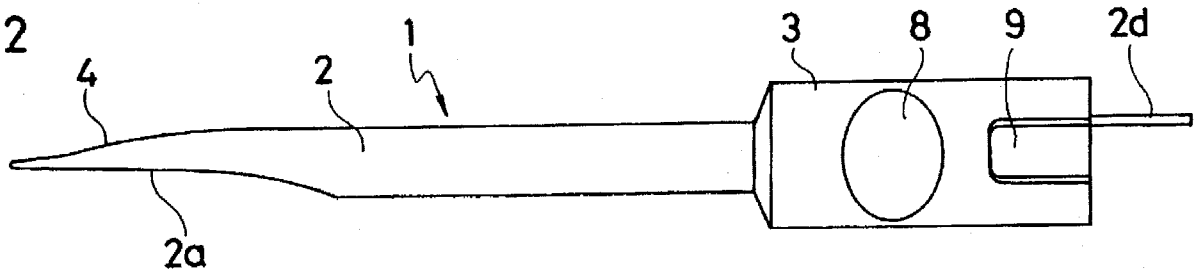
FIG. 2 is a top plan view of the hollow needle.
Figure 3:
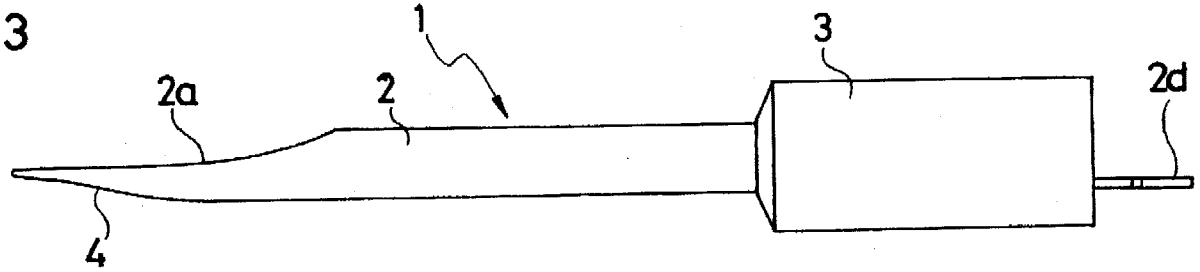
FIG. 3 is a bottom plan view of the needle.

As shown in FIG. 2, in the shank 3 there are formed an engaging part 8 for receiving a stopper of the tag attacher therein and a crossbar receiving part 9 of a groove form for receiving the crossbar b of tag pin t and guiding it to a rear end portion of the central bore 5, same as in the conventional hollow needle.

As shown in FIG. 7 and FIG. 8, continuous to a Fear end of the intermediate part **2*b* of the blade 2, the cutter part 2*d* in the form of a flat plate is formed, and with a notched portion 10 provided to the fixing part 2*c*, the part of this fixing part 2*c* is tightly fitted into the shank 3, whereby the blade 2 and the shank 3** are integrally structured.

Figure 4:
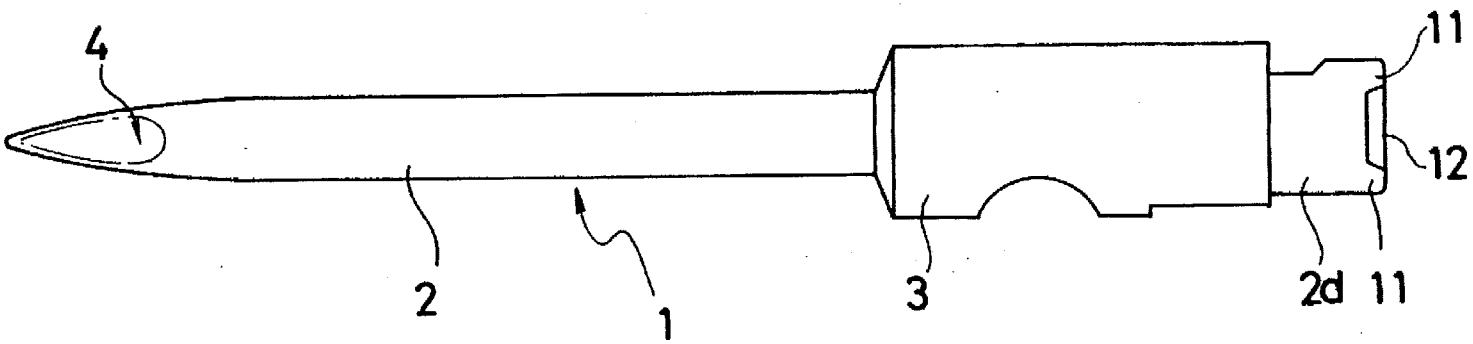
FIG. 4 is a rear view of the needle.

Then, as shown in FIG. 4, the cutter part **2*d* is formed with a cutting blade 12 by grinding the cutter part 2*d* except for protective parts 11, 11 at the sides of the cutting blade 12. The protective parts 11 devoid of the cutting blade 12 are provided so as not to permit the cutting blade 12 to be touched by fingers and/or any other physical part of a person engaging in the operation. Further, along one edge of the cutter part 2*d*, a stepped part 13** is formed, which is provided for the purpose of positioning at the time of placing the punched piece of steel plate in the mold in molding the needle.

FIG. 10 to FIG. 13 are views taken for illustration in further detail of essential parts (such as the front end part) of the hollow needle according to the invention.

As shown in FIG. 10, the point indicated at **2*e* of the blade 2 lies on the center line shown at 2*f* of the needle and is shaped in the form of a nib having a sharp point as shown in FIG. 1. In the part of this nib, the concave resistance reducing part 4 is formed as shown in FIGS. 5, 7, 8, 11 and 12**.

Each time when the tag pin t is shot with the tag attacher shown in FIG. 25, the piston 26 is operated by the operation lever 24 of the tag attacher to undergo an advance motion to bring its leading end to a position in the opening 6, but the extent to which the leading end of the piston 26 is advanced is up to the rear part of the opening 6 at which the wall forming the opening 6 has a semicircular sectional shape, and the advancing motion of the leading end of the piston 26 is stopped closely in front of the resistance reducing part 4.

Figure 13:
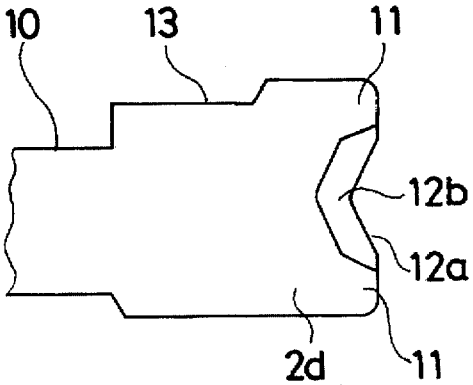
FIG. 13 is a fragmentary front elevation, showing a cutter part.

FIG. 13 shows another embodiment of the invention, in which the cutter part **2*d* has a cutting blade 12*a*, which comprises a V-shaped blade, and with this cutting blade 12*a***, the connection part c of tag pin t is cut while it is securely positioned at the bottom of the V-shape.

Figure 12:
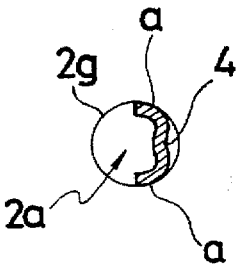
FIG. 12 is a sectional view, taken on line F—F in FIG. 11.

FIG. 14 to FIG. 16 show a still another embodiment of the invention, and in the hollow needle according to this embodiment, an expanded part g is formed at the point of the hollow needle 2 shown in FIG. 11 to FIG. 13. In the cases of production of hollow needles by press working, a thin metal plate is processed by pressing, so that the front end part and the wall around the opening of the needles tend to be excessively sharpened, when a danger is likely that for example fibers of an article are accidentally cut by the needle. To prevent such problem from occurring and also to attain an additional effect of reducing the resistance at the time of application of the needle, the expanded part E is provided to impart a roundness at the point of the needle. Further, the front end part of this needle is shaped taking after a kind of nibs.

To ascertain advantageous results and/or effects of the present invention, a series of experiments was carried out:

An interlining cloth for belts of a thickness of 0.8 mm was placed on a metal plate having a thickness of 12 mm and formed with a hole of a diameter of 3.5 mm, and the hollow needle attached to a needle holder at a front end of a needle resistance tester (a push-pull gauge) was applied through the interlining cloth at a piercing speed of 1.67 mm/second (100 mm/minute) to determine the force required for the needle piercing.

With each of the needles, the above test was conducted 50 times to obtain the following results:

(a) With a hollow needle produced by machining a metal rod or bar, the values found were within a range of 1.1 to 2.7 kg and their mean value was 1.98 kg.

(b) With a commercially obtained hollow needle produced by press working, the values found were within a range of 1.2 to 2.3 kg, and their mean value was 1.6 kg.

(c) With a hollow needle according to the present invention, the values found were within a range of 0.8 to 1.7 kg, and their mean value was 1.34 kg.

Thus, to take the resistance value of the hollow needle produced by machining as 100, the comparable value found of the commercially obtained hollow needle produced by press working is 81%, and in clear contrast to this, the value found of the hollow needle formed with the resistance reducing part according to the present invention 68%. Therefore, it is seen that in comparison with the hollow needle produced by machining, the resistance of the hollow needle according to the present invention is improved by about 32% and fairly greatly improved over the conventional or existing hollow needle produced by press working.

Figure 20:
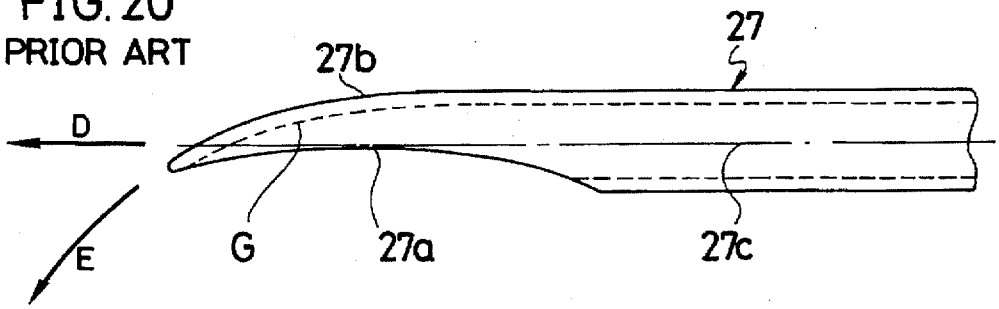
FIG. 20 PRIOR ART
FIG. 20 is a fragmentary side elevation, showing essential portions of a conventional hollow needle produced by press working.
Figure 21:
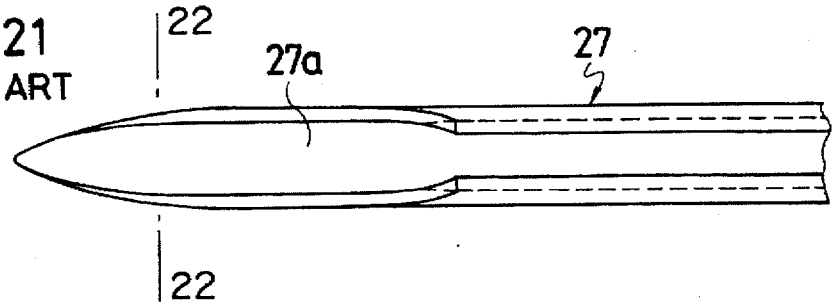
FIG. 21 PRIOR ART
FIG. 21 is a front elevation of the hollow needle shown in FIG. 20.
Figure 22:
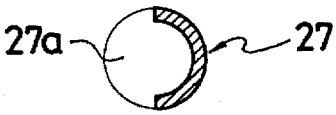
FIG. 22 PRIOR ART
FIG. 22 is a sectional view, taken on line H—H in FIG. 21.

Further, the above commercially obtained hollow needle was of the configuration shown in FIG. 20 to FIG. 22 and its characteristic to be advanced straight in the direction of the needle application was poor. However, the needle according to the present invention had the configuration shown in FIG. 10 to FIG. 12 or in FIG. 14 to FIG. 16 and, in particular, as shown in FIG. 12, a cross-sectional view taken on line F—F of FIG. 11 it was formed with a resistance reducing part 4 comprising a concave surface within a phantom circle 2*g* at the point of sectioning and the resistance reducing part 4 was partly recessed inwardly of the phantom circle 2*g*, so that the area of contact of for example a woven fabric with the needle was reduced to a portion a at the point of the phantom circle 2*g*, whereby this needle could exhibit a desirable characteristic of being applied straight in the direction of piercing even though it was produced by press working.

Also, the resistance reducing part 4 comprising a concave surface is formed like a backbone and the section modulus is increased, so that the needle according to the invention is improved in the strength and the durability in use. In addition, it is possible to reduce the area size of the phantom circle 2*g* to reduce the width of the front end part 2*a* of the hollow needle 1, so that the resistance in application of the needle can be reduced according to the present invention.

As described above, the hollow needle for tag attachers according to the present invention comprises a blade 2 formed by a press working of a metal plate and a shank 3 made of a synthetic resin and integrally secured to a rear end part of the blade 2. A middle part of the front end part 2*a* of the blade 2 has a semicircular shape in section, and the resistance reducing part 4 is formed on the outer surface of the front end part 2*a* by a depression inwardly of the outer periphery of the front end part 2*a*.

Also, the blade 2 comprises the front end part 2*a*, the intermediate part 2*b*, the fixing part 2*c* and the cutter part 2*d*, and the intermediate part 2*b* comprises a cylinder provided at a side thereof with a slit 7, of which a rear end portion is flattened to form the cutter part 2*d*, the web at a rear end of which is reduced to form a cutter blade 12, which is provided at its sides with protective parts 11 and 11.

Further, the resistance reducing part 4 formed by processing a portion of the front end part 2*a* to have a concave curved surface and depressed inwardly of the phantom circle as shown in FIG. 12 has a length slightly smaller than the distance between the point of the hollow needle 1 and a point to be reached by the leading end of the piston 26 in the tag attacher when the piston 26 is put to advance motion, as shown in FIG. 10 and FIG. 11.

The hollow needle 1 is provided in a front end portion thereof with a resistance reducing part 4 formed by a concave surface as above, so that when the hollow needle 1 is applied partly through merchandise for example in attaching price tags to the latter, the resistance the needle has to undergo is advantageously reduced not only because the area of contact of the outer surface in a front end portion of the hollow needle 1 with for example fabric or fiber-made texture is reduced but also because the needle does not undergo the application of force tending to deviate the direction of its application from that of its central axis.

Accompanying to the reduction of the resistance, the operation efficiency for tagging can be improved and also the danger of impairing merchandise is suppressed.

Moreover, the front end part of the hollow needle is in a condition of being structurally reinforced, so that the duration in use of the needle 1 is increased and the frequency at which replacement of needles has to be done is reduced. Also, accompanying to the improvement made in or relating to the duration in use, it is possible to relatively limit the web thickness of the material for needles, and the above various effects according to the present invention can be further enhanced.

What is claimed is:

1. A hollow needle for tag attachers, comprising a blade made by press working of a thin metal plate and a shank of a synthetic resin integrally secured at a rear end part of the blade; the blade including a front end part formed with an opening and having a point, and an intermediate part formed with a slit in a side wall thereof, the slit in the intermediate part being connected to the opening of the front end part; the front end part further having in a middle part thereof a semicircular shape in cross section, the front end part being formed in an outer surface portion thereof on a side opposite the opening with a resistance reducing part provided by partly depressing an outer periphery thereof.

2. A hollow needle as claimed in claim 1, wherein the resistance reducing part formed in the front end part of the blade comprises a concave surface in cross section.

3. A hollow needle as claimed in claim 1, wherein the resistance reducing part formed in the front end part of the blade comprises a substantially flat surface in cross section.

4. A hollow needle as claimed in claim 1, wherein the blade comprises the front end pad, the middle part, a fixing part and a cutter part.

5. A hollow needle as claimed in claim 1, wherein the blade comprises the front end part, the intermediate part, a fixing part and a cutter part, the intermediate part comprising a cylinder provided at a side thereof with the slit, the rear end part of the blade being flattened to form the cutter part, the cutter part including a web at a rear end of the cutter part, the web being reduced to form a cutter blade, the cutter part further including protective parts provided at sides of the cutter blade.

6. A hollow needle as claimed in claim 1, wherein the resistance reducing part has a length about one-half as large as the distance between said point of said front end part and a position to be reached by a leading end of a piston of a tag attacher when such piston is farthest advanced inside the needle.

7. A hollow needle for tag attachers, comprising:

a blade, made by press working of a thin metal plate, the blade including a front end part and a fixing part, said front end part having a point, a backside, a front side and an opening in said front side with a concave cross section, said back side of the front end part having a cross section which is concave with a radius $R_1$ at the most forward part of said front end part, said cross section of said back side becoming convex with a radius $R_3$ toward the rear of said front end part, and said backside having a resistance reducing part provided by a depression in the backside; and a shank of a synthetic resin integrally secured at said fixing part of the blade.

8. A hollow needle as claimed in claim 7, wherein the resistance reducing part formed in the front end part of the blade comprises a concave surface in cross section.

9. A hollow needle as claimed in claim 7, wherein the resistance reducing part formed in the front end part of the blade comprises a substantially flat surface in cross section.

10. A hollow needle as claimed in claim 7, wherein the blade comprises the front end part, an intermediate part, a fixing part and a cutter part.

11. A hollow needle as claimed in claim 7, wherein the blade comprises the front end part, an intermediate part, a fixing part and a cutter part, the intermediate part comprising a cylinder provided at a side thereof with a slit, a rear end portion of the blade being flattened to form the cutter part, the cutter part including a web at a rear end of the cutter part, the web being reduced to form a cutter blade, the cutter part further including protective parts provided at sides of the cutter blade.

12. A hollow needle as claimed in claim 7, wherein the resistance reducing part has a length about one-half as large as the distance between said point of said front end part and a position to be reached by a leading end of a piston of a tag attacher when such piston is farthest advanced inside the needle.

* * * * *